United States Patent [19]

Luthi

[11] Patent Number: 4,480,392

[45] Date of Patent: Nov. 6, 1984

[54] CONDUCTION DRYER FOR FLAKED OR FLUFFED MATERIAL

[75] Inventor: Oscar Luthi, Nashua, N.H.

[73] Assignee: Ingersoll-Rand Company, Woodcliff Lake, N.J.

[21] Appl. No.: 340,099

[22] Filed: Jan. 18, 1982

[51] Int. Cl.[3] ..... F26B 3/08; F26B 17/10

[52] U.S. Cl. ..... 34/10; 34/34; 34/57 A; 34/191; 432/15; 432/58

[58] Field of Search ..... 34/10, 57 R, 57 A, 191, 34/34; 432/15, 58; 110/245; 159/4 A, 4 E

[56] References Cited

U.S. PATENT DOCUMENTS

| | | | |
|---|---|---|---|
| 1,281,597 | 10/1918 | Lessing | 34/57 A |
| 2,750,681 | 6/1956 | Berry | 34/57 A |
| 2,763,478 | 9/1956 | Parry | 34/57 A |
| 3,618,655 | 11/1971 | Lockwood | 159/4 A |

FOREIGN PATENT DOCUMENTS

| | | | |
|---|---|---|---|
| 861905 | 1/1980 | U.S.S.R. | 34/10 |

*Primary Examiner*—Larry I. Schwartz

*Attorney, Agent, or Firm*—F. S. Troidl

[57] ABSTRACT

The dryer includes at least one vessel, means for heating the outside of the vessel to dry wet material in the vessel and a gas inlet in the lower section of the vessel.

The pressure of the gas fed to the gas inlet is predetermined and transports the material through the vessel in the form of a loose material bed. The dried material is removed from the vessel.

A high pressure gas pulse generator feeds pulses into the vessel to agitate the material in the loose bed to prevent compaction of the material, and avoid channeling through the loose material bed. The motion of the loose material destroys vapor film on the inside shell of the vessel to maintain good heat transfer through the shell.

7 Claims, 2 Drawing Figures

CONDUCTION DRYER FOR FLAKED OR FLUFFED MATERIAL

Figure 1:
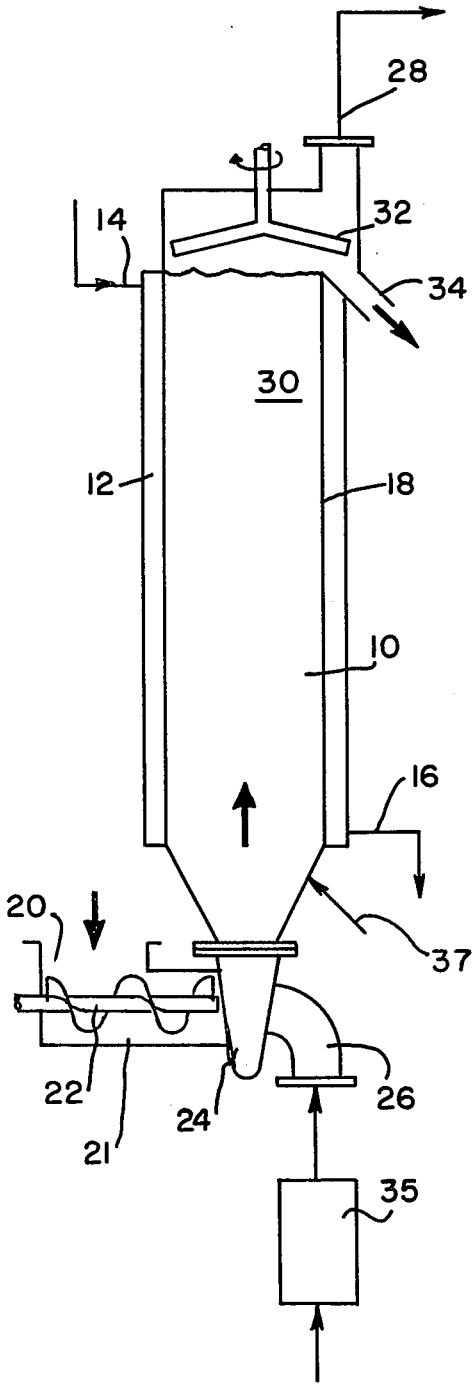

This invention is a new and improved dryer for drying wet flaked or fluffed, fibrous or peat-like material.

Most drying of crumbled, flaked or fluffed material is done by direct burning of fuel to produce hot combustion gases. The hot combustion gases contact the product and dry the product. Typical examples of this type of dryer are: flash dryers, fluidized bed dryers and rotating drum dryers.

With prior art dryers, contamination of the product may occur if clean burning fuels are not available. Usually, it is necessary that the product be broken up into very fine fluffy material for efficient drying. In flash drying the fine fluffy particles are conducted through the vessel in a matter of seconds, for example, four seconds. It is necessary to use a very high drying temperature in an attempt to heat these fine fluffy particles as they speed through the vessel.

The high drying temperature and the large amounts of drying gas needed by the prior art requires large fans with high horsepower consumption of flow the drying gas into the vessel. The high temperatures required produce a fire hazard and sometimes the fluffly fine material catches fire. The air is polluted when malodorous products such as sludge and manure are dried.

The abovementioned disadvantages of the prior art are eliminated by this invention. Low grade fuels may be used. A long retention time is provided in the vessel containing the material to be dried. This retention time may be approximately 10 to 15 minutes compared to only 4 seconds for a typical flash dryer. Because of the long retention time it is not necessary to have the very high drying temperature required by flash drying. Also, because of the long retention time, whether or not the material being dried consists of uniform very fine particles is not as critical as it is using prior art dryers. The product temperature is not raised above ignition temperature thereby eliminating any fire hazard. There is less or no air pollution.

Briefly described, this invention is a dryer for continuously drying wet flaked or fluffed fibrous, or peat-like material. Examples of material which may be dried are sludge, manure, wood pulp, peat moss or other industrial products in the flaked or fluffed stage. The dryer comprises at least one vessel with means for heating the outside of the vessel. The heat is conducted through the shell of the vessel to dry the wet material in the vessel. Means including a gas inlet are provided for the admission of gas at a predetermined pressure into the lower section of the vessel to transport the material through the vessel in the form of a loose material bed. High pressure gas pulses are fed into the vessel to agitate the material bed to prevent compaction, avoid channeling, and maintain good heat transfer from the inside shell of the vessel to the material. The dried material is removed from the vessel.

Briefly described, my new method of drying wet flaked or fluffed fibrous or peat-like material comprises the steps of continuously supplying a gas at predetermined pressure to a vessel to move the wet material through the vessel in the form of a loose material bed. Heat is applied from the outside of the vessel to dry the wet material by heat conduction as it moves through the vessel. High pressure gas pulses are fed to the vessel to agitate the material in the bed to prevent compaction of the material, avoid channeling through the material, and maintain good heat transfer from the inside shell of the vessel to the material. The used gas is continuously removed from the vessel.

Figure 2:
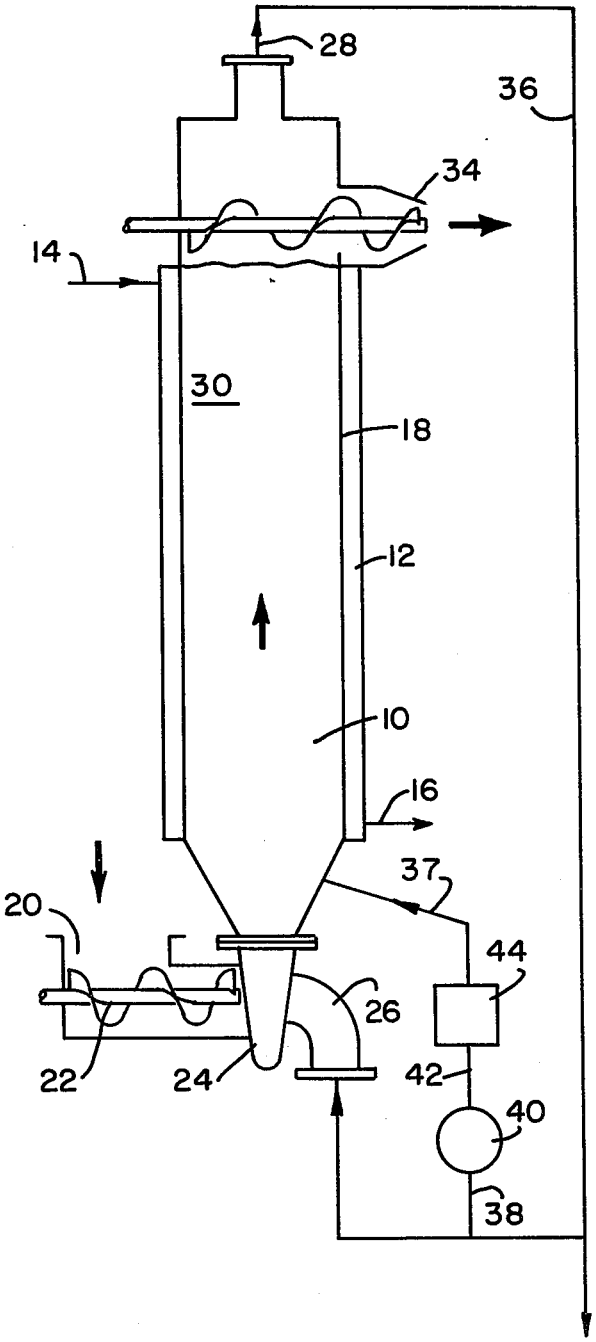

The invention, as well as its many advantages, may be further understood by reference to the following description and drawing in which:

FIG. 1 is a schematic flow diagram illustrating one preferred embodiment of the invention; and FIG. 2 is a schematic flow diagram illustrating a second preferred embodiment of the invention.

In the various figures, like parts are referred to by like numbers. Referring to the drawing, and more particularly to FIG. 1, the material to be dried is fed to the vessel 10. A heat jacket 12 surrounds the vessel 10. A heating fluid such as steam is fed to the jacket 12 by means of a steamline 14 connected to the upper part of jacket 12. Condensate from the jacket 12 is removed by means of condensate line 16 at the bottom of jacket 12. The heat from the steam in jacket 12 is conducted through the shell 18 of the vessel 10 to dry the wet material in the vessel by heat conduction.

The wet material to be dried is fed to the inlet 20 of member 21 and screw conveyor 22 feeds the wet material to a fluffer-blower combination 24 where the wet material is broken up into small pieces.

A gas inlet 26 is used for continuously feeding a material transporting gas through the fluffer-blower 24 into the lower section of vessel 10 and through the vessel 10. The used gas after drying the material in the vessel 10 is removed along with moisture from the material by means of gas outlet 28 at the top of the vessel. The gas fed through gas inlet 26, fluffer-blower 24, vessel 10, and gas outlet 28 is at a controlled predetermined pressure so that the flaked or fluffed material is transported through the vessel 10 in the form of a loose material bed 30.

If desired, the material transporting gas may be preheated by the optional heat exchanger 35. However it is important to note that very little or no drying energy is supplied by the material transporting gas. The drying heat for removing moisture from the material is supplied by conduction through the shell 18. Any available heat source may be used. Exhaust steam at 360° F. from a 150 psi turbine is suggested. The heat may also be supplied by burning coal or other available fuel such as peat moss or sludge.

The vessel 10 may be kept at atmospheric pressure. The wet material is fed to inlet 20 at room temperature. Unless heated by the optional heat exchanger the material transporting gas is at room temperature. The high pressure gas pulses are at room temperature. Air may be used as the material transporting gas and the high pressure gas pulses.

The dry product is removed from the vessel 10 by means of discharge scraper 32 and dry product exit 34. In general it may be necessary to use additional stages in which case the partially-dried product would be fed to the next stage.

As formerly stated some of the advantages of this invention are that the bed 30 of material has a long retention time in the vessel 10 of, say, from 10 to 15 minutes. Because of this long retention time the temperature of the transporting gas need be only a few degrees above the wet bulb temperature. Because of this long retention time it is not as critical for the material in the bed 30 to be uniformly fine particles as would be the case with a flash dryer where the resident time is only a few seconds, thus requiring a very high transporting gas temperature.

However, the material in the bed 30 does have a tendency to compact. This compaction is undesirable because it decreases the drying efficiency and the drying of the material in bed 30 will not be uniform. Therefore, I provide in this invention for the continuous generation of high pressure gas pulses. The frequency of the high pressure gas pulses is determined by how often it is necessary to agitate the bed 30 and may, for example, range from about 4 per minute to 30 per minute. The pulses are fed into the vessel 10 by means of a pulsed gas inlet 37. The high pressure pulses fed upwardly through vessel 10 agitate the material in bed 30 to prevent the compaction of the material, aids in the heat transfer through the vessel shell 18 because the pulsing destroys vapor film on the inside of shell 18 which is the major heat transfer barrier, and prevents channeling of the material transporting gas in vessel 10.

Since there is no direct burning of fuel, a transporting gas other than an oxygen-containing gas may be used, eliminating any fire hazard. We can recycle the used gas back to the vessel 10 thus eliminating air pollution. This arrangement is shown in FIG. 2 where steam is used as the material transporting gas and the high pressure pulses. To accomplish this a recycle line 36 interconnects the saturated steam outlet 28 and the steam inlet 26. Thus steam which has already been used to transport the bed 30 through vessel 10 may be recycled back to the vessel and reused.

The recycle line 36 may also be connected by means of line 38 to a steam compressor 40 where the recycled steam is compressed. The compressed steam is fed through line 42 to a steam accumulator 44 and pulsed steam fed through line 37 to the bottom of vessel 10.

In the operation of the embodiment of FIG. 1 the wet material to be dried is fed by screw conveyor 22 into the fluffer-blower 24. Gas at predetermined pressure moves the wet material bed through vessel 10 in the form of a loose material bed. As the bed moves through the vessel 10 it is dried by steam in the jacket 12 by heat conduction through the shell 18 of vessel 10. High pressure gas pulses are fed by means of line 37 through the vessel 10 to agitate the material in the bed 30 to prevent compaction of the material.

In the operation of the embodiment of FIG. 2, steam is used as the material transporting gas. Pulsed steam agitates the material bed 30. The saturated steam from outlet 28 is recycled for reuse as material transporting gas and pulsed steam.

I claim:

1. A dryer for drying wet flaked or fluffed fibrous or peat-like material comprising: at least one vessel; a material inlet; a material outlet vertically spaced above the material inlet; means for heating the outside of the vessel, which heat is conducted through the shell of the vessel to dry wet material in the vessel as all the wet material is moved from the material inlet to a height adjacent the material outlet; means including a material transporting gas inlet for the admission of material transporting gas at a predetermined pressure into the lower section of the vessel, the material transporting gas being primarily used to continuously move all the material in the form of a loose material bed from the material inlet to a height adjacent the material outlet; mechanical means for removing all the material from the vessel through the material outlet; high pressure gas pulse generating means; and means for feeding high pressure gas pulses from the high pressure gas pulse generating means into the vessel and into the loose material bed to agitate the material in the loose material bed; and a gas outlet in the upper section of the vessel above the material outlet through which gas containing moisture leaves the vessel.

2. A dryer in accordance with claim 1 wherein: the means for heating the outside of the vessel is a heating jacket surrounding the vessel through which heating fluid is flowed.

3. A dryer in accordance with claim 1 wherein a recycle line interconnects the gas outlet and the material transporting gas inlet.

4. A dryer in accordance with claim 3 wherein the recycle line is also connected to the high pressure gas pulse generating means.

5. A method of drying wet flaked or fluffed fibrous or peat-like material comprising the steps of: moving all the material upwardly in a vessel in the form of a loose material bed from a material inlet to a height adjacent a material outlet vertically spaced above the material inlet by supplying a gas at predetermined pressure to the lower section of the vessel; heating the outside of the vessel to dry the wet material by heat conduction as it moves upwardly through the vessel; mechanically removing all the loose material from the vessel through the material outlet; supplying pulses of gas at high pressure to the vessel and into the loose material bed to agitate the material in the loose material bed; and removing the used gas containing moisture from the vessel through a gas outlet located above the material outlet.

6. A method in accordance with claim 5 wherein the supplied gas and the pulsed gas are at room temperature.

7. A method in accordance with claim 5 wherein the supplied gas is steam, the pulsed gas is steam, and the saturated steam from the vessel is recycled and used to move the wet material through the vessel, and supply pulses of gas to the vessel.

* * * * *